US006210806B1

(12) United States Patent
Hidaka et al.

(10) Patent No.: US 6,210,806 B1
(45) Date of Patent: Apr. 3, 2001

(54) MARTENSITIC STAINLESS STEEL HAVING OXIDE SCALE LAYERS

(75) Inventors: Yasuyoshi Hidaka; Toshiro Anraku, both of Hyogo; Hisashi Amaya, Kyoto, all of (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/253,140

(22) Filed: Feb. 19, 1999

(30) Foreign Application Priority Data

Feb. 23, 1998 (JP) ..... 10-040178
Dec. 25, 1998 (JP) ..... 10-368608

(51) Int. Cl.[7] ..... B32B 9/00; B32B 15/04

(52) U.S. Cl. ..... 428/469; 428/469; 428/472; 428/472.1; 428/701; 428/702; 138/145; 138/146

(58) Field of Search ..... 428/469, 472, 428/472.1, 701, 702; 138/145, 146

(56) References Cited

U.S. PATENT DOCUMENTS 5,156,805 10/1992 Imai et al. .
5,442,005 * 8/1995 Brugarlas et al. ..... 524/276
5,591,391 * 1/1997 Igarashi et al. ..... 420/38
5,593,571 * 1/1997 Heyse et al. ..... 208/134
5,804,056 * 9/1998 Pempera et al. ..... 205/661

FOREIGN PATENT DOCUMENTS 54-120246 9/1979 (JP) .
57-19329 2/1982 (JP) .
58-116903 7/1983 (JP) .
61-26766 2/1986 (JP) .
4-131324 5/1992 (JP) .
63-238217 10/1998 (JP) .

* cited by examiner

*Primary Examiner*—Deborah Jones
*Assistant Examiner*—Lymarie Miranda
(74) *Attorney, Agent, or Firm*—Clark & Brody

(57) ABSTRACT

The martensitic stainless steel product comprises a base steel and a dual oxide scale layer on a surface of the steel, wherein the dual scale layer includes an inner scale layer containing $FeCr_2O_4$ and $Fe_3O_4$ as main components and an outer scale layer containing $Fe_3O_4$ as a main component and having an outermost $Fe_2O_3$ layer; or includes an inner scale layer containing $FeCr_2O_4$ and FeO as main components and an outer scale layer containing FeO and $Fe_3O_4$ as main components and having an outermost $Fe_2O_3$ layer. If the product is a steel pipe, it exhibits excellent corrosion resistance when used for an oil country tubular goods or line pipe.

8 Claims, No Drawings

MARTENSITIC STAINLESS STEEL HAVING OXIDE SCALE LAYERS

This application claims priority under 35 U.S.C. §§119 and/or 365 to 10-40178 filed in Japan on Feb. 23, 1998 and 10-368608 filed in Japan on Dec. 25, 1998, the entire content of which is herein incorporated by reference.

BACKGROUND OF THE INVENTION

1. Field of the Invention

The present invention relates to martensitic stainless steel product (in forms such as steel pipes, steel forgings, steel bars, and steel sheets) which contains Cr in an amount of 9 to 16 wt. % and which is suitably used as structural material for chemical plants as well as for oil wells and gas wells (hereinafter collectively called "oil wells") and pipelines thereof. In particular, the present invention relates to martensitic stainless steel product which has oxide scale layers and which exhibits excellent surface properties and high corrosion resistance, and to a production method therefor.

2. Description of the Related Art

Examples of steel used in oil wells include seamless steel pipe and welded steel pipe, which are also referred to as oil country tubular goods or line pipe. Generally, seamless steel pipe is manufactured through a hot-rolling pipe-making method as described below.

A billet serving as raw material is heated to about 1100 to 1300° C., and subjected to piercing by use of a piercing mill of a skew-roll type (Mannesmann piercing mill), to thereby obtain a hollow shell. Subsequently, the hollow shell is subjected to elongation processing. Any of a variety of mills may be employed as the elongation mill used in elongation, and in particular a mandrel mill (Mannesmann-mandrel mill) is widely employed, as it provides excellent dimensional accuracy and productivity.

The above-mentioned mandrel mill elongates a hollow shell by means of a mandrel bar which has a lubricant for hot rolling applied on its surface and which is inserted into the hollow shell. The temperature of the hollow shell under elongation processing is normally about 1050 to 1200° C. as measured at the entrance of the mill, and about 800 to 1000° C. as measured at the exit of the mill.

The pipe hot-rolled by a mandrel mill is generally called pipe for finish rolling. The pipe for finish rolling is reheated to about 850 to 1100° C. in a reheating furnace as needed, and finished by use of a finish rolling mill such as a stretch reducing mill or a sizing mill at a finish temperature of about 800 to 1000° C., to thereby obtain a pipe of a predetermined product size.

Also, seamless steel pipe may be manufactured through a hot-extrusion pipe-making method represented by the Ugine Sejournet method and a hot-push pipe-making method represented by the Ehrhardt push bench method. In this case, after a seamless steel pipe undergoes hot-extrusion in a hot-extrusion pipe making method, a lubricant (generally a glass lubricant) is removed from the seamless steel pipe, and the pipe is then fed to the subsequent step. Also, after the pipe is subjected to hot-pushing in the hot-push pipe-making method, at least one of the inner surface and the outer surface of the seamless steel pipe is machined for reduction of eccentricity of its wall thickness, and the pipe is then fed to a subsequent step.

In contrast, welded steel pipe is manufactured from hoop steel or plate steel through a pipe-making method such as an ERW (electric-resistance-welding) pipe-making method, a TIG (Tungsten Inert Gas) welding pipe-making method, a laser welding pipe-making method, or a UO (UO press-forming)-SAW (Submerged Arc Welding) pipe-making method, to thereby obtain a pipe of a predetermined product size, followed by a subsequent step.

The thus-finished seamless steel pipe or welded steel pipe of predetermined product size is fed to a subsequent finishing step, in which the pipe is generally subjected to a heat-treatment for imparting a predetermined strength. Specifically, steel pipe manufactured from martensitic stainless steel containing Cr in the amount of 9 to 16 wt. % (hereinafter called simply "martensitic stainless steel") is subjected to a heat-treatment including the steps of reheating to 900° C. or more, quenching, and tempering at 600 to 750° C.

Subsequently, the thus-heat-treated martensitic stainless steel pipe is generally subjected to a descaling step comprising pickling or shot blasting, a straightening step performed by use of a straightening mill such as a rotary straightener, and a non-destructive testing step executed through visual check or ultrasonic flaw detection. The pipe is then shipped as is or after application of a rust-inhibiting oil on the inner and outer surfaces thereof.

The descaling step comprising pickling or shot blasting of the heat-treated martensitic stainless steel aims at removal of oxide scale (hereinafter called simply "scale") which has inevitably been formed on the inner and outer surfaces due to heating to 1300 to 1600° C. in the preceding step.

If the scale formed on the inner and outer surfaces is partially peeled off during a straightening step, a testing step (including temporary storage), or transportation after shipping, the resultant unevenness on the pipe surfaces not only impairs product appearance, but also lowers the accuracy of a non-destructive test. In the worst case, the non-destructive test itself may become impossible to perform. Also, in application of a rust-inhibiting oil, such unevenness leads to nonuniform thickness of the applied oil.

In addition, if scale is peeled off during transportation after shipping, rust forms at the peeled-off portion. Further, in the case where such a product is used as oil country tubular goods or line pipe, the peeled-off portion becomes susceptible to pitting corrosion.

However, a descaling processing comprising pickling or shot blasting requires many steps and great cost, which leads to a decrease in productivity, an increase in production cost, and environmental pollution due to employment of a large amount of pickling liquid or shot blasting grains. For this reason, in recent years, consideration has been given to simplification of a descaling processing, as well as to shipment of steel pipe having scale that has not be subjected to the descaling processing.

On the surfaces of martensitic stainless steel pipe manufactured through a conventional method, two layers, i.e., an inner scale layer and an outer scale layer (hereinafter collectively referred to as a "dual scale layer"), are formed at the termination of heat-treatment. The outer and inner scale layers are relatively large in thickness, at about 70 $\mu$m and about 50 $\mu$m respectively, and poor in adhesion. Therefore, the steel pipe has a disadvantage in that a descaling step cannot be omitted in the manufacture thereof.

The inner scale layer is an oxide layer containing $FeCr_2O_4$ in an amount of about 35 vol. % with the remainder substantially made up of $Fe_3O_4$ or FeO as a main component. The outer scale layer is an oxide layer which, when $FeCr_2O_4$ and $Fe_3O_4$ are the main components of the inner scale layer, contains $Fe_3O_4$ in an amount of about 80 vol. %, and when $FeCr_2O_4$ and FeO are the main components of the inner scale layer, contains FeO in the amount of about 60 vol. % and $Fe_3O_4$ in the amount of about 25 vol. %, with the remainder substantially made up of $Fe_2O_3$. Also, the outer scale layer has a surface of $Fe_2O_3$.

In some cases, the scale contains a trace amount of spinel oxides such as $Fe_2SiO_4$ and $FeO.Mn_2O_3$ in addition to the above-mentioned oxides.

Since the corrosion resistance of a product having scale during use as oil country tubular goods or line pipe has not yet been investigated, the corrosion mechanism and corrosion resistance (corrosion resistance to carbon dioxide gas, as well as resistance to localized corrosion and resistance to sulfide stress cracking in an atmosphere containing hydrogen sulfide) over long-term use remains unknown. Therefore, the product having scale involves a disadvantage in that a descaling step cannot be omitted.

The reason why the dual scale layer on the inner pipe surface are thicker than the dual scale layer on the outer pipe surface as mentioned above is that the atmospheric gas (air) contacting the inner pipe surface circulates more slowly than does that contacting the outer pipe surface.

Japanese Patent Application Laid-Open (kokai) No. 57-19329 discloses a method of controlling the scale formed on stainless steel product, in which scale is removed from the surfaces of a steel plate prior to quenching.

However, since this method employs a descaling step comprising long-time pickling or grinding outside an assembly line, insertion of the descaling step into a line of steps arranged in a continuous manner is difficult. Therefore, in practice this method cannot be applied to manufacture of seamless stainless steel where material is processed through respective steps in a short time.

SUMMARY OF THE INVENTION

An object of the present invention is to provide martensitic stainless steel product having an oxide scale layer in which the scale layer is not peeled off even partially during a finishing step or during transportation after shipping, and therefore no rust is formed at the thus-exposed portions, and which exhibits high corrosion resistance when used as oil country tubular goods or line pipe. Another object of the present invention is to provide a method of manufacturing such martensitic stainless steel product having an oxide scale layer.

The subject matters of the present invention are (1) martensitic stainless steel product having an oxide scale layer, and (2) a method of manufacturing the martensitic stainless steel product having an oxide scale layer, as described below.

In the present invention, for the sake of simplicity, "oxide scale" is referred to as "scale," an "inner layer of scale" is referred to as an "inner scale layer," and an "outer layer of scale" is referred to as an "outer scale layer." (1) A steel product of the present invention comprises a base steel of martensitic stainless steel containing ("%" used herein represents "% by weight") C: not greater than 0.5%, Si: not greater than 1%, Mn: not greater than 2%, Cr: 9 to 16%, Ni: 0 to 7%, Mo: 0 to 7%, Ti: 0 to 0.2%, Zr: 0 to 0.2%, Nb: 0 to 0.1%, and sol. Al: 0 to 0.1%, and a dual scale layer formed on the surfaces of the base steel. The dual scale layer comprises two layers, i.e., an inner scale layer containing $FeCr_2O_4$ and $Fe_3O_4$ as main components, and an outer scale layer containing $Fe_3O_4$ as a main component and having an outermost layer consisting of $Fe_2O_3$, which is present on top surface of the outer scale layer, or an inner scale layer containing $FeCr_2O_4$ and FeO as main components, and an outer scale layer containing FeO and $Fe_3O_4$ as main components and having an outermost layer consisting of $Fe_2O_3$, which is present on top surface of the outer scale layer. Also, the dual scale layer has a total thickness of 50 $\mu$m or less, and the outer scale layer has a thickness of 15 $\mu$m or less.

The dual scale layer formed on a surface of the base steel preferably has a total thickness of 30 $\mu$m or less. Further, the outermost layer consisting of $Fe_2O_3$ preferably has a thickness of 5 $\mu$m or less including zero.

The Mn content of martensitic stainless steel serving as the base steel is preferably 1.5% or less.

The above-described martensitic stainless steel product may be a seamless steel pipe or a welded steel pipe, having a dual scale layer on at least one of its inner and outer surfaces. In addition, these pipes preferably have film of a rust-inhibiting oil on the surface of the dual scale layer. (2) The above-described martensitic stainless steel product is advantageously manufactured through the method described below.

A base steel of martensitic stainless steel containing C: not greater than 0.5%, Si: not greater than 1%, Mn: not greater than 2%, and Cr: 9 to 16%, Ni: 0 to 7%, Mo: 0 to 7%, Ti: 0 to 0.2%, Zr: 0 to 0.2%, Nb: 0 to 0.1%, and sol. Al: 0 to 0.1%, is subjected to reheat-quenching. Subsequently, at least the outer scale layer of the dual scale layer formed on a surface is removed through descaling treatment, and then a base steel is tempered under conditions such that the steel is maintained at 600 to 750° C. for 20 to 100 minutes.

Alternatively, martensitic stainless steel containing C: not greater than 0.5%, Si: not greater than 1%, Mn: not greater than 2%, and Cr: 9 to 16%, Ni: 0 to 7%, Mo: 0 to 7%, Ti: 0 to 0.2%, Zr: 0 to 0.2%, Nb: 0 to 0.1%, and sol. Al: 0 to 0.1%, may be formed into a product shape through hot-working, and tempered at 600 to 750° C. for 20 to 100 minutes without reheat-quenching. In this method, finishing through hot-working is preferably completed at 900° C. or more.

In either method described above, the thickness of the outer scale layer is preferably reduced to zero or less than 5 $\mu$m by removing the $Fe_2O_3$ layer present on the surface of the outer scale layer through mechanical descaling means after tempering.

Furthermore, in either method described above, the Mn content of martensitic stainless steel serving as the base steel is preferably 1.5% or less.

Of these methods, the former is suitable for the manufacture of seamless steel pipe or welded steel pipe which is produced through a hot-rolling pipe-making method, a hot-push pipe-making method, or a hot-extrusion pipe-making method; whereas the latter is suitable for the manufacture of seamless steel pipe which is produced through a hot-rolling pipe-making method.

DETAILED DESCRIPTION OF THE INVENTION

To solve the aforementioned problems, the present inventors conducted careful studies of the oxidation phenomena on a surface of martensitic stainless steel under manufacture, as well as the relationship between scale thickness and adhesion, the relationship between resistance to rust formation and corrosion resistance in oil exploitation circumstances, and the relationship between production conditions and scale thickness, in manufacture of seamless steel pipe through a hot-rolling pipe-making method.

As a result, the present inventors have attained the following findings.

As described above, a dual scale layer is formed on each of the inner and outer surfaces of a martensitic stainless steel pipe containing 9 to 16 wt. % Cr which is manufactured through a conventional method. The dual scale layer formed on the outer pipe surface has a large total thickness of about 70 μm, and that formed on the inner pipe surface has a large total thickness of about 50 μm. These dual scale layers are formed during reheating in a quenching furnace mainly designed for quenching. The thickness of the outer scale layer accounts for ½ or more of the total thickness of the dual scale layer.

Of these dual scale layer having a large total thickness, the inner scale layer has a dense structure and excellent adhesion. In contrast, the outer scale layer is considerably porous and has many fine cracks (micro cracks), and has poor adhesion. Generally, peeling-off of a scale layer substantially takes the form of partial peeling-off of the outer scale layer.

However, when the total thickness of the dual scale layer is 50 μm or less, preferably 30 μm or less, and the thickness of the outer scale layer is 15 μm or less, formation of micro cracks is significantly suppressed and the outer scale layer remains porous. As a result, peeling-off in a scale layer is substantially prevented, and thus resistance to rust formation is improved. Consequently, if the period from completion of manufacture to commencement of use is as short as about three months, formation of rust can be prevented without application of a rust-inhibiting oil.

A dual scale layer having a total thickness of 50 μm or less, the outer scale layer having a thickness of 15 μm or less, can be formed by a process comprising reheat-quenching a base steel; removing at least the outer scale layer of the dual scale layer from each of the surfaces of the base steel; and tempering the base steel at 600 to 750° C. for 20 to 100 minutes.

Also, a dual scale layer having a total thickness of 30 μm or less, the outer scale layer having a thickness of 15 μm or less, can be formed by a process comprising hot-rolling a base steel for finishing; quenching by air-cooling the base steel without reheating for quenching; and tempering the base steel at 600 to 750° C. for 20 to 100 minutes.

Martensitic stainless steel product having a dual scale layer formed on its surfaces to a total thickness of 50 μm or less, preferably 30 μm or less, the outer scale layer having a thickness of 15 μm or less, is usable as oil country tubular goods and line pipe. In the case of this steel, if the scale layers are corroded, the resultant corrosion product is innocuous in a carbon dioxide gas atmosphere, resulting in a retarded rate of corrosion of the base steel. Therefore, there are no adverse effects on the corrosion resistance of the base steel to carbon dioxide gas.

In contrast, in a carbon dioxide gas atmosphere containing hydrogen sulfide, localized corrosion tends to occur, and corrosion resistance (resistance to localized corrosion and resistance to sulfide stress cracking) is insufficient. Therefore, the present inventors investigated the cause, and obtained the following findings.

The aforementioned localized corrosion occurs only when a layer of $Fe_2O_3$ exists on the outermost surface of a scale layer. The localized corrosion results in formation of a pit, and cracking occurs on the bottom of the resultant pit due to concentration of stress, i.e., sulfide stress cracking (SSC), at which deep micro cracks reach the surface of the base steel.

This phenomenon is attributable to the following mechanism: a macro cell comprising a cathode (the surface of a scale layer) and an anode (the surface of a base steel) is formed between the base steel and the scale layer, which cause a dissolution reaction of the metal. Further, the macro cell is confirmed to be formed only when a layer of $Fe_2O_3$ exists on the outermost surface of a scale layer.

Further, the present inventors thoroughly investigated the effect of $Fe_2O_3$ on formation of the macro cell, and reached the finding that, in a carbon dioxide gas atmosphere containing hydrogen sulfide, a cathode reaction at the scale surface, which is the counter reaction to the dissolution reaction of metal occurring at the anode site, is a reducing reaction of $Fe_2O_3$.

During further research on the effect of the thickness of the $Fe_2O_3$ layer, the inventors also found that a thicker $Fe_2O_3$ layer induced more remarkable localized corrosion. This is because, the dissolution reaction of metal, which is an anode reaction, requires a reducing reaction at the cathode corresponding to the amount of reacted substance, and therefore the larger the amount of $Fe_2O_3$ existing at the cathode site, the further the anode reaction (dissolution reaction of metal) proceeds.

As is generally known, if an anode site is formed at a part of the surface of a base steel in a carbon dioxide gas atmosphere containing hydrogen sulfide, the cathode reaction corresponding thereto is a hydrogen generation reaction effected through reduction of hydrogen ions.

As described above, the cathode reaction occurred when scale layers exist on the surfaces of a base steel is a reducing reaction from $Fe_2O_3$ existing on the outermost surface of the scale layers to $Fe_3O_4$.

Also, the corrosion current generated after formation of a macro cell decreases with time. This decrease has a correlation with the thickness of a $Fe_2O_3$ layer existing on the outermost surface of the scale layer. That is, when the entire amount of $Fe_2O_3$ is completely reduced to $Fe_3O_4$, the cathode reaction ceases, dissolution of metal ceases, and the corrosion current becomes undetectable.

In other words, whether or not a cathode reaction ceases before excessive formation of micro cracks depends on the thickness of the $Fe_2O_3$ layer existing on the outermost surface of the scale layers, in such a case where micro cracks are generated in a scale layer to such an extent that reaches the base steel so that they serve as portions for potential localized corrosion. If the $Fe_2O_3$ layer has a thickness of 5 μm or less, localized corrosion is suppressed to a level at which no problems arise in practical use, and SSC due to concentration of stress is also suppressed at the bottoms of the pits.

The present inventors have completed the invention based on the foregoing findings, and the invention will be described specifically hereunder. The percentage of an alloying element refers to percentage by weight (wt. %).

(1) Chemical Composition of Base Steel

An object of the present invention is to provide martensitic stainless steel product, and the base stainless steel is a martensitic stainless steel that comprises at least C, Si, Mn and Cr in the following amounts, for the reasons given below:

C:

Carbon content must be 0.5% or less, as amounts in excess of 0.5% cause cracking during firing. In view of obtaining strength reliably, C content is desirably as low as possible, preferably 0.35% or less, more preferably 0.25% or less.

Si:

Silicon is added for the purpose of deoxidizing molten steel. For this purpose, Si content is desirably not greater than 0.1%. However, in the case that the molten steel is sufficiently deoxidized with Al, addition of Si is not required. On the other hand, when the Si content is greater than 1%, δ ferrite is deposited to reduce productivity of hot-working procedures and to impair mechanical characteristics as well. Therefore, Si content is limited to 1% or less.

Silicon is effective in suppressing scale formation and in improving adhesion, especially when added in an amount of 0.35% or greater. If the total thickness of the dual scale layer is sought to be reduced and adhesion is sought to be improved, Si content is preferably at 0.35% or greater.

Mn:

Manganese is effective in binding S, which is incidentally contained in steel, in the form of MnS. When Mn content is 0.1% or more, Mn significantly improves hot-workability of the steel. However, if the Mn content is in excess of 2%, ductility is impaired to a great extent, and $FeO.Mn_2O_3$ spinel-type oxide is formed when the steel surface is oxidized. The $FeO.Mn_2O_3$ spinel-type oxide makes an inner layer brittle to cause peeling-off of the scale. Therefore, Mn content is limited to not more than 2%.

Manganese content may be 1.5% or lower, more desirably 1% or less, for substantially completely preventing the formation of the $FeO.Mn_2O_3$ spinel-type oxide and for forming an inner scale layer which is not peeled off easily.

Cr:

Chromium is the most important element for producing martensitic stainless steel product having the specific features of the present invention. When Cr content is lower than 9%, the resistance against corrosion, more specifically, corrosion resistance against carbon dioxide gas and the resistance against sulfide stress cracking, may not be obtained. Meanwhile, if the Cr content is in excess of 16%, not only is δ ferritic phase formed to impair corrosion resistance, but hot-workability is also decreased to lower productivity. Also, the mechanical characteristics of the base steel may be difficult to control by heat treatments (quenching and tempering), and the material cost is increased to impair economic production. Thus, Cr content is between 9 to 16%.

Martensitic stainless steel product having the above-mentioned chemical composition satisfies the requirements for the base stainless steel of the present invention. However, in addition to the aforesaid four elements, any one of the following elements may also be contained.

Ni:

Nickel is effective in improving mechanical characteristics of the steel. Therefore, Ni is optionally added when the mechanical characteristics are to be improved. However, when the Ni content is less than 0.01%, the improvement is not sufficient. When the Ni content is in excess of 7%, the amount of retained austenite increases to the extent that the steel attains an overall austenitic structure and fails to produce a martensitic structure need in the steel of the present invention. Consequently, when Ni is added, Ni content may be between 0.01 to 7%.

Mo:

Molybdenum is effective in improving corrosion resistance and therefore is optionally added when this purpose is to be attained. However, when the Mo content is less than 0.5%, no significant effect in improvement of the corrosion resistance is obtained. On the other hand, when the Mo content is in excess of 7%, a large amount of δ ferrite deposits to impair hot-workability. Therefore, when Mo is added, Mo content may be 0.5 to 7%.

Ti:

Titanium is effective in obtaining good strength and stable structure of a welded portion, and therefore is optionally added when these purposes are to be attained. However, the above effect is not sufficient when the Ti content is below 0.005%. In contrast, when the content is in excess of 0.2%, a large amount of intermetallic compound such as TiNi precipitates to impair hot-workability. Therefore, when Ti is added, Ti content may be 0.005 to 0.2%.

Zr:

Zirconium, like Ti described above, is effective for obtaining good strength and stable structure of a welded portion. Therefore, Zr is optionally added for obtaining the same effects; however, Zr has no significant effect at a content below 0.01%. On the other hand, the content greater than 0.2% impairs mechanical properties. Therefore, when Zr is contained, the Zr content may be 0.01 to 0.2%.

Nb:

Niobium is effective in achieving fine structure; therefore, Nb is optionally added when this effect is to be attained. However, the effect is not significant if the Nb content is below 0.005%. On the other hand, when the Nb content is in excess of 0.1%, mechanical characteristics are impaired. Therefore, when Nb is contained, the Nb content may be 0.005 to 0.1%.

Al:

Aluminum is effective in deoxidizing molten steel and in achieving fine micro structure of a steel. Therefore, Al is optionally added when these effects are to be attained. However, these effects are not obtained when the Al content is below 0.001%. When the Al content is in excess of 0.1%, non-metallic inclusion increases to impair corrosion resistance. Consequently, when Al is added, the Al content may be 0.001 to 0.1%. In the present invention, Al refers to sol. Al (acid soluble Al).

(2) Structure and Thickness of the Scale Layers

The martensitic stainless steel product according to the present invention refers to a martensitic stainless steel product on which a dual scale layer is formed. When the steel is a steel pipe, the dual scale layer is formed on at least one of inner surface and outer surface of the pipe. The dual scale layer consists of two layers. The inner scale layer is an oxide layer comprised by $FeCr_2O_4$ (approximately 35 vol. %) and an oxide including $Fe_3O_4$ or FeO as a primary component (substantially the balance), as mentioned previously. The outer scale layer is constituted by $Fe_3O_4$ (approximately 80 vol. %) when the inner scale layer's main components are $FeCr_2O_4$ and $Fe_3O_4$, or FeO (approximately 60 vol. %), $Fe_3O_4$ (approximately 25 vol. %) and $Fe_2O_3$ (balance) when the inner scale layer's main components are $FeCr_2O_4$ and FeO. In the latter case, the outermost surface of the outer scale layer is made of $Fe_2O_3$.

The total thickness of the dual scale layer is 50 μm or less, desirably 30 μm or less, and the thickness of the outer scale layer is 15 μm or less.

The reason for the above-described limitations is that when the thickness of the outer scale layer is in excess of 15 μm, micro cracks tend to be formed on the outer scale layer to reduce rust resistance and to reduce adhesion considerably, resulting in local peeling off of the outer scale layer.

For preventing SSC (Sulfide Stress Cracking) in a $CO_2$ atmosphere containing hydrogen sulfide ($H_2S$), the preferable thickness of the $Fe_2O_3$ layer on the surface of the outer scale layer is 5 μm or less. The reason for this limitation is that the cathode reaction that causes local corrosion of the steel having a scale layer is the reaction in which $Fe_2O_3$ is reduced to $Fe_3O_4$. Briefly, corrosion electric current, after macrocells are formed between the scale layer and the base material, decreases according to time. This phenomenon is related to the thickness of the $Fe_2O_3$ layer on the surface of the outer scale layer. The cathode reaction, i.e., dissolution reaction of metal, continues until all $Fe_2O_3$ is reduced to $Fe_3O_4$. Therefore, if the thickness of the $Fe_2O_3$ is 5 μm or less, corrosion reaction is arrested at a level on which no problems may be caused in practical use. The lower limit of the $Fe_2O_3$ layer thickness is not necessarily defined, but the most desirable thickness is zero, for the above-mentioned reason.

As mentioned previously, the dual scale layer may contain a little amount of spinel oxide such as $Fe_2SiO_4$ or $FeO.Mn_2O_3$ in addition to the above-mentioned oxides, but such spinel oxide is permissible so long as the chemical composition of the steel falls within the above-described range.

(3) Manufacturing Method

Hereunder, the manufacturing method for producing a martensitic stainless steel product having a dual scale layer will be described for the case the steel is used for the production of a seamless steel pipe by a hot-rolling pipe making method.

A hot-rolling pipe making method may be any method so far as the required size precision is not so high as to require mechanical cutting procedures. For piercing, example methods are a method employing a Mannesmann-plug mill, a method employing a Mannesmann-Assel mill, a method employing a Mannesmann-Disher mill, and a method employing a Mannesmann-Pilger mill, in addition to the aforementioned method employing a Mannesmann-mandrel mill using an inclined-roll-type Mannesmann-piercer. Further examples include a Press piercing-mandrel method and a method employing a Press piercing-plug mill method, which use a press piercing mill for piercing.

In many cases a method employing a Mannesmann-mandrel mill is applied, which is optimal in terms of size precision and productivity. The martensitic stainless steel seamless pipe having a dual scale layer (hereunder called "seamless steel pipe") according to the present invention is desirably produced by the method employing a Mannesmann-mandrel mill.

The steel billet made of the martensitic stainless steel product having the aforementioned chemical composition and manufactured by a continuous casting process is heated to 1100 to 1300° C. and pierced by a Mannesmann piercer to form a hollow shell, and is then elongated by a Mandrel mill to a pipe for finish rolling at 800 to 1000° C.

The pipe for finish rolling is then reheated to 850 to 1000° C., if needed, in a reheating furnace, and finished to a seamless steel pipe of a prescribed size by use of a stretch reducing mill or a sizer.

Thus resultant seamless steel pipe is reheated in a quenching furnace and requenched. Then at least an outer scale layer of the dual scale layer formed on the surface of the pipe is removed and the pipe is tempered in a tempering furnace at a temperature within the range of 600 to 750° C. for 20 to 100 minutes. Through these treatments, a seamless steel pipe having a dual scale layer according to the present invention, which has the required mechanical characteristics and has the following dual scale layers: a dual scale layer on the outer surface has a total thickness of 50 μm or less with the thickness of the outer scale layer being 15 μm or less; and a dual scale layer on the inner surface has a total thickness of 30 μm or less with the thickness of the outer scale layer being 15 μm or less.

In an alternative method, after completion of the elongation procedure, the resultant finished seamless steel pipe may be made to the prescribed size, by being brought directly into a tempering furnace for tempering at 600 to 750° C. for 20 to 100 minutes, without quenching. By this method, the seamless steel pipe according to the present invention is produced. The pipe has required mechanical characteristics and has, on both the inner and outer pipe surfaces, dual scale layers having a total thickness of 30 μm or less, the outer scale layers having a thickness 15μm or less.

The reason for the selected conditions, 600 to 750° C. and 20 to 100 minutes are as follows. If the tempering procedure exceeds 750° C. and 100 minutes, in the former method, the total thickness of the dual scale layer on the outer surface becomes greater than 50 μm, and the thickness of the outer scale layer becomes greater than 15 μm, the total thickness of the dual scale layer on the inner surface becomes greater than 30 μm, and the thickness of the outer scale layer becomes greater than 15 μm. In the latter method, the total thickness of the dual scale layer becomes greater than 30 μm on both surfaces, and the thicknesses of the respective outer scale layers become greater than 15 μm. As a result, the outer layers becomes excessively porous and contain a number of fine cracks to easily cause peeling off. Under the tempering conditions of below 600° C. and below 20 minutes, the required mechanical characteristics are not reliably obtained.

The reheating temperature in the quenching furnace in the former process and the finishing temperature in the stretch reducing in the latter process are preferably 900° C. or higher. The reason why the necessary strength of the high grade steel requires quenching from a temperature as high as 900° C. or higher is the martensitic stainless steel of the chemical composition, according to the present invention, can be quenched at a low temperature, below 900° C., with yielding a low-strength product.

The tempering procedure employed in the former method or the tempering procedure employed in the latter method is desirably performed in an atmosphere where water vapor content is lower than 12 vol. %. This limitation is imposed in order to avoid the disadvantage that, when the water vapor content is not less than 12 vol. %, the outer scale layer undesirably becomes more porous and is peeled off more easily.

The former method produces an outer surface dual scale layer having a total thickness of 50 μm or less, the outer scale layer having a thickness of 15 μm or less, and an inner surface dual scale layer having a total thickness of 30 μm or less, the outer scale layer having a thickness of 15 μm or less; and the latter method produces outer surface and inner surface dual scale layers having a total thickness of 30 μm or less, the outer scale layers having a thickness 15 μm or less, for the reasons given below.

Briefly, in most cases the dual scale layer formed in the billet heating and reheating procedures for pipe for finish rolling, especially the scale layer formed on the outer surface of the pipe, can be removed by a pressurized water descaler located at the entrance of the piercing mill, Mandrel mill, or stretch reducing mill. Moreover, most of the scale layer formed after the descaling is peeled off during the elongation treatment, due to plastic deformation. Therefore, little or no scale is observed on the surface of the seamless steel pipe.

Therefore, in the former method, a dual scale layer is formed during the reheating process at 900° C. or higher in the quenching furnace after the finish elongation. The total thickness of the dual scale layer is approximately 70 μm on the outer surface of the pipe and approximately 50 μm on the inner surface. The thickness of the inner scale layer is almost as same as that of the outer scale layer. Of the dual scale layers, at least the outer scale layer is removed and then the pipe is tempered. Thereafter, the inner scale layer becomes thicker and is oxidized at the top surface to form a new outer scale layer.

However, on the surface of the martensitic stainless steel product that has the aforementioned chemical composition according to the present invention, the outer scale layer, which has less adhesion than does the inner scale layer, is formed and grows mainly in a temperature range of 800 to 1000° C., and is substantially not formed at a lower temperature such as 750° C. or less. Therefore, in the former method, the thickness of the scale layer does not meet the following: for the inner surface—a total thickness of greater than 30 $\mu$m with the thickness of the outer scale layer being greater than 15 $\mu$m; and for the outer surface—a total thickness of greater than 50 $\mu$m with the thickness of the outer scale layer being greater than 15 $\mu$m. Also, in the latter method, the thickness of the scale layer does not meet the following: for each of the inner and outer surfaces—a total thickness of the dual scale layer is greater than 30 $\mu$m, with the outer scale layer being greater than 15 $\mu$m in thickness.

In the former method, after reheating in the quenching furnace, descaling treatment of the outer surface is desirably performed by pressurized water, and descaling treatment of the inner surface is desirably performed by pickling or shot blasting. Alternatively, brush descaling may be performed. The conditions of the descaling treatments may be adjusted in accordance with the thickness of the scale layers, which can be predicted from the heating conditions in the tempering furnace. In view of product quality, desirably both the inner scale layer and the outer scale layer are removed simultaneously; however, such processing requires costs and number of steps the same as conventional processes, and may not achieve reduction in production costs and prevention of environmental pollution. Therefore, in view of economy and prevention of environmental pollution, desirably only the outer layer is removed.

In contrast, the latter method eliminates the necessity of descaling after reheating in the tempering furnace and finish elongation procedures, with the result that this method can achieve remarkable cost reduction and prevention of environmental pollution, because it eliminates use in large amounts of shot grains and pickling solution. Also, the emission of carbon dioxide gas, which has been implicated as a cause of global warming, can be reduced.

In the case in which the seamless steel pipe is produced by hot-extrusion pipe-making method represented by the Ugine Sejournet method, after extrusion the pipe is brought to room temperature for removing lubricant. In the case in which the seamless steel pipe is produced by the hot-push pipe-making method, after hot-pushing, the pipe is brought to room temperature as a result that at least one of the inner and outer surfaces undergoes machining for reducing eccentricity of wall thickness. Therefore, the former method is applied, with the heat treatment used therein being included, to these pipe-making processes.

When the steel pipe is a welded pipe produced through the aforementioned ERW (electric-resistance-welding) pipe-making method, the TIG (Tungsten Inert Gas) welding pipe-making method, the laser welding pipe-making method, or the UO (UO press-forming)-SAW (Submerged Arc Welding) pipe-making method, the pipe, which has undergone the welding pipe-making process, is at room temperature excepting the welded portion. Therefore, the production method, including heat treatment, favors the former method as is the case with seamless steel pipes produced by the above-described hot-extrusion pipe making method.

A $Fe_2O_3$ layer is always formed on the surfaces of the scale layers of seamless steel pipe and welded pipe having a dual scale layer produced by the aforementioned process. When the $Fe_2O_3$ layer is thick, SSC (Sulfide Stress Cracking) occurs in a carbon dioxide gas atmosphere containing hydrogen sulfide. Therefore, for obtaining SSC resistance in a $CO_2$ environment containing hydrogen sulfide, the thickness of the $Fe_2O_3$ layer may be 5 $\mu$m or less, desirably zero. Although no particular method is defined as a method for bringing the thickness of the $Fe_2O_3$ layer to 5 $\mu$m or less, preferably zero, the following procedure may be used.

After final treatment (tempering), the surface of the steel pipe is treated by way of mild shot blasting, pressurized water descaling, or brush descaling, so as to remove only the $Fe_2O_3$ layer, which is present at the top surface of the outer scale layer. Instead of such mechanical treatment for partially or completely removing the $Fe_2O_3$ layer, there may be employed a method in which the inside atmosphere of the quenching furnace and/or the tempering furnace has a low oxygen partial pressure of $10^{-2}$ atm. or less or has a low temperature of 750° C. or less to thereby reduce the amount of $Fe_2O_3$ formed on the top surface.

The above-mentioned manufacturing method can be applied to the production processes for bar steel, sheet steel, and steel forgings, in addition to steel pipe (seamless steel pipe and welded pipe).

EMBODIMENT

EXAMPLE 1

Billets consisting of 9 kinds of martensitic stainless steels having respective chemical compositions shown in Table 1 and an outer diameter of 192 mm were provided.

TABLE 1

| Steel | Chemical Composition (Wt. %) | | | | | | | | |
|---|---|---|---|---|---|---|---|---|---|
| sample | C | Si | Mn | P | S | Ni | Cr | Mo | Ti |
| a | 0.03 | 0.44 | 1.5 | 0.011 | 0.001 | 2.0 | 10.3 | 0.01 | — |
| b | 0.02 | 0.25 | 0.9 | 0.014 | 0.001 | 6.0 | 13.0 | 1.0 | — |
| c | 0.02 | 0.25 | 0.9 | 0.014 | 0.001 | 0.1 | 13.0 | 3.0 | 0.1 |
| d | 0.02 | 0.25 | 0.9 | 0.013 | 0.001 | 6.0 | 13.0 | 0.1 | 0.1 |
| e | 0.21 | 0.46 | 0.6 | 0.013 | 0.001 | 0.08 | 13.0 | — | — |
| f | 0.01 | 0.35 | 0.3 | 0.014 | 0.001 | 5.7 | 12.5 | 2.0 | — |
| g | 0.02 | 0.25 | 0.9 | 0.014 | 0.001 | 6.0 | *8.0 | 3.0 | 0.1 |
| h | *0.6 | 0.25 | 0.9 | 0.014 | 0.001 | 6.0 | 13.0 | 3.0 | 0.1 |
| i | 0.02 | 0.25 | *2.1 | 0.014 | 0.001 | 6.0 | 13.0 | 3.0 | 0.1 |

Note: 1) Balance: Fe and incidental impurities.
Note: 2) "*": Outside the ranges specified by the present invention.

Each of the billets was heated to 1100 to 1200° C. by use of a rotary-type heating furnace; subjected to processing in a skew-roll-type Mannesmann piercing mill to obtain a hollow shell having an outer diameter of 192 mm, a wall thickness of 16 mm, and a length of 6.65 m; and subjected to processing in a mandrel mill to obtain a pipe for finish rolling having an outer diameter of 151 mm, a wall thickness of 6.5 mm, and a length of 20 m. Subsequently, the pipe for finish rolling was maintained at 1100° C. for 20 minutes in a reheating furnace, and then subjected to processing in a stretch reducing mill to obtain a seamless steel pipe having an outer diameter of 63.5 mm, a wall thickness of 5.5 mm, and a length of 56 m. At this time, the finish temperature was 900 to 1000° C.

Each of the finish-rolled seamless steel pipes was subjected to one of the following processes (1) to (3), fed to a finishing step for straightening, and coated with rust-inhibiting oil (linseed oil) on only the inside surface (but oil coating of some of steel pipes was omitted) to be subjected to the following corrosion resistance test 1 and test 2.

(Process conditions after finish rolling)

(1) Quenching: water-cooling after heating at 980° C. for 65 minutes→tempering: heating at 710° C. for 100 minutes (A comparative method)

(2) Quenching: water-cooling after heating at 980° C. for 65 minutes→shot-blasting for removing only an outer scale layer on the inside surface of the steel pipe→tempering: heating at 710° C. for 100 minutes (3) Direct quenching: air-cooling after finish rolling→tempering: heating at 710° C. for 100 minutes The total thickness of the dual scale layer and the thickness of outer scale layer formed on the inside surface of the steel pipe after the above-described processing conditions (1) to (3) were measured by observing the cross-sectional profile of test pieces from the processed steel pipe through use of an optical microscope. At this time, the structures of the scale layers were classified into the following categories S1 and S3 by checking whether or not the scale layers of the test pieces had micro cracks and simultaneously the structure of the scale layers. The distinction between the inner scale layer and the outer scale layer was performed by measuring the secondary X-ray strength of Cr by use of line analysis along the thickness of the dual scale layer performed through use of an Electron Probe Micro Analyzer (EPMA) before the optical microscopic observation.

S1: the scale consisting of the above-described two layers has a total thickness of 30 $\mu$m or less and an outer scale thickness of 15 $\mu$m or less, and few micro cracks.

S3: the scale consists of the same two layers as in S1, but has many micro cracks.

Further, the surface properties were investigated by visually observing the inside surface of the straightened steel pipes. The evaluation was performed by counting the number of the peeled portions of the outer scale layer as follows: The number of peeled portions being 300/m$^2$ or less: good "O"; the number of peeled portions being than 300/m$^2$: poor "X".

The results are indicated in the comprehensive evaluation column (mark "O": (good), mark "X": (poor)). (Corrosion resistance test 1; a test simulating rust formation caused by peeling and falling out of scale after shipping)

An aqueous solution prepared by diluting synthetic sea water with 100-fold volume of water was applied to the inner surface of steel pipes which had undergone vibration of an amplitude of 10 mm and 60 cycles/minute for one hour. The pipes were exposed to a 50° C. and 98% humidity environment for one week to investigate whether rust formed on the pipes. The mark "O" was assigned in the case of no rust forming and the mark "X" was assigned in the case of rust forming. (Corrosion resistance test 2, a corrosion resistance test simulating an oil well environment containing a carbon dioxide gas)

Among the steel pipes to be tested, the rust-inhibiting-oil-coated pipes were stripped of their rust-inhibiting-oil film, and subjected to an autoclave test in which the pipes were dipped in a 25% NaCl aqueous solution at 180° C. under a 30 atm-$CO_2$ environment for 300 hours. Corrosion resistance in carbon dioxide gas was evaluated by measurement of corrosion weight loss. The mark "O" was assigned in the case of a corrosion weight loss of 1 g/m$^2$ per hour or less and the mark "X" was assigned in the case of a corrosion weight loss of more than 1 g/m$^2$ per hour.

The results are summarized in Table 2. In the processing condition column and the scale structure column of Table 2, the processing conditions and the scale structures are shown by use of the same marks ((1) to (3), and S1 and S3) as described above.

TABLE 2

| Category | Test No. | Steel sample | Processing condition | Thickness of scale Total | Thickness of scale Outer layer | Structure of scale | Surface properties after straightening | Pipe-formability | Application of rust-inhibitor | Corrosion resistance I | Corrosion resistance II | evaluation |
|---|---|---|---|---|---|---|---|---|---|---|---|---|
| Present invention | 1 | a | ② | 28 | 14 | S1 | ○ | ○ | Yes | ○ | ○ | ○ |
| | 2 | b | | 25 | 12 | | ○ | ○ | | ○ | ○ | ○ |
| | 3 | c | | 26 | 13 | | ○ | ○ | | ○ | ○ | ○ |
| | 4 | d | | 25 | 12 | | ○ | ○ | No | ○ | ○ | ○ |
| | 5 | e | | 25 | 12 | | ○ | ○ | | ○ | ○ | ○ |
| | 6 | f | | 20 | 10 | | ○ | ○ | | ○ | ○ | ○ |
| | 7 | a | ③ | 28 | 14 | | ○ | ○ | Yes | ○ | ○ | ○ |
| | 8 | b | | 30 | 15 | | ○ | ○ | | ○ | ○ | ○ |
| | 9 | c | | 25 | 12 | | ○ | ○ | | ○ | ○ | ○ |
| | 10 | d | | 30 | 15 | | ○ | ○ | No | ○ | ○ | ○ |
| | 11 | e | | 22 | 11 | | ○ | ○ | | ○ | ○ | ○ |
| | 12 | f | | 24 | 12 | | ○ | ○ | | ○ | ○ | ○ |
| Comparison | 13 | a | ① | 45 | 22 | S3 | x | ○ | Yes | x | ○ | x |
| | 14 | b | | 40 | 20 | | x | ○ | | x | ○ | x |
| | 15 | c | | 40 | 20 | | x | ○ | | x | ○ | x |
| | 16 | d | | 40 | 20 | | x | ○ | | x | ○ | x |
| | 17 | e | | 50 | 30 | | x | ○ | No | x | ○ | x |
| | 18 | f | | 50 | 28 | | x | ○ | | x | ○ | x |
| | 19 | g | | 45 | 22 | | x | ○ | Yes | x | x | x |
| | 20 | h | | 45 | 23 | | x | x | No | x | ○ | x |
| | 21 | i | | 50 | 25 | | x | ○ | Yes | x | ○ | x |
| | 22 | g | ② | 28 | 14 | S1 | ○ | ○ | | ○ | x | x |
| | 23 | h | | 25 | 12 | | ○ | x | No | ○ | ○ | x |
| | 24 | i | | 25 | 12 | S3 | x | ○ | Yes | x | ○ | x |
| | 25 | g | ③ | 28 | 14 | S1 | ○ | ○ | | ○ | x | x |
| | 26 | h | | 25 | 12 | | ○ | x | No | ○ | ○ | x |
| | 27 | i | | 30 | 15 | S3 | x | ○ | Yes | x | ○ | x |

As is apparent from Table 2, all of the steel pipes of Comparative Examples (Test Nos. 13 to 21) which were processed in the process (1) after finish rolling and were not processed in the descaling step after reheating in the quenching furnace had, regardless of their chemical components, a dual scale layer on the inside surface having a total thickness of 40 μm or more, an outer scale layer thickness of 20 μm or more, and scale structure S3 characterized by having many micro cracks. As a result, the steel pipes had poor surface properties inside the pipe after straightening, and rust formed in the corrosion test because of their outer scale layer peeling, regardless of the presence or absence of the rust-inhibiting oil coating.

The steel pipes consisting of steel g of Comparative Examples (Test Nos. 19, 22, and 25) showed poor results in the corrosion test 2; namely, poor corrosion resistance in a carbon dioxide gas atmosphere because of their poor Cr content of 8%, regardless of their total dual scale layer thickness and scale structures.

Further, the steel pipes consisting of steel h of Comparative Examples (Test Nos. 20, 23, and 26) suffered quench cracks in the quenching process and poor formability for pipe-making, regardless of the processing conditions after finish rolling, because of their excess C content of 0.6% falling outside the ranges defined by the present invention.

The steel pipes consisting of steel i of Comparative Examples (Test Nos. 24 and 27) manufactured under the processing condition (2) or (3) of the present invention after finish rolling had a total dual scale layer thickness of 30 μm or less on the inside surface and an outer scale layer thickness of 15 μm or less and both thickness are rather thin. However, because the pipes had a Mn content of 2.1% or more, which falls outside the ranges defined by the present invention, the pipes had the scale structure S3 characterized by having many micro cracks, due to production of much $FeO.Mn_2O_3$-based spinel-type oxide. As a result, the pipes had poor surface properties inside the pipe after straightening and suffered rust formation in corrosion test 1, regardless of the presence or absence of rust-inhibiting oil coating, because of peeling of the inner scale layer in the test.

By contrast, the steel pipes of Examples of the present invention (test Nos. 1 to 12) consisting of steel a to f having chemical compositions within the ranges defined by the present invention manufactured under the processing conditions (2) or (3) after finish rolling had a total dual scale layer thickness of 30 μm or less on the inside surface, an outer scale layer thickness of 15 μm or less, and the scale structure S1 characterized by having few micro cracks. As a result, the steel pipes had excellent surface properties inside the pipes after straightening and suffered no rust formation in corrosion test 1, regardless of the presence or absence of rust-inhibiting oil coating, because of no peeling of the outer scale layer in the test. Further, the results of corrosion test 2 conducted on the inside surface with the dual scale layers; namely, the corrosion resistance in a carbon dioxide gas environment, was excellent. The steel pipes suffered no quench cracks in the quenching process and had excellent formability for pipe-making.

EXAMPLE 2

Billets consisting of 9 kinds of steels, the same as those used in Example 1, of an outer diameter of 192 mm were provided and processed in the same manner as in Example 1 into seamless steel pipes having an outer diameter of 63.5 mm, a wall thickness of 5.5 mm, and a length of 56 m. At this time, the finish temperature was 800 to 1000° C.

Subsequently, each of the finish-rolled seamless pipes was processed under one of the above-described process conditions (1) to (3), as in Example 1. However, descaling used in the processing condition (2) was applied to just the dual scale layers on the outside surface of the steel pipes. Only the outer scale layer was removed by spraying high-pressure water at a gauge pressure of 110 kgf/cm$^2$.

Then, each of the heat-treated steel pipes was fed to the finishing step for straightening, coated with the rust-inhibiting oil (linseed oil) on only the outside surface (but, oil coating was omitted for some of the steel pipes), and subjected to corrosion tests 1 and 2 under the same conditions as in Example 1.

Test pieces were cut from the processed pipes. The total thickness of the dual scale layer formed on the outside surface of the steel pipes, the thickness of the outer scale layer, the scale structures, and the presence or absence of micro cracks were investigated by use of the same methods as employed in Example 1. In this Example, the scale structures were classified into the following S1, S2, and S3.

S1: scale consisting of the above-described two layers having a total thickness of 30 μm or less, an outer scale thickness of 15 μm or less, and few micro cracks.

S2: scale consisting of the same two layers as in S1 and having a total thickness of 50 μm or less, an outer scale thickness of 15 μm or less, and few micro cracks.

S3: scale consisting of the same two layers as in S1 or S2, but having many micro cracks.

Further, the surface properties were investigated by visually observing the outside surface of the straightened steel pipes. The evaluation was performed by use of the same standards as in Example 1. The results are indicated in the comprehensive evaluation column (mark "O": (good), mark "X": (poor)).

The results of corrosion tests 1 and 2 were evaluated with reference to the same standards as in Example 1.

These results are summarized in Table 3. In the processing condition column and the scale structure column of Table 3, the processing conditions and the scale structures are shown in terms of the same marks ((1) to (3), and S1 to S2) as described above.

TABLE 3

| Category | Test No. | Steel sample | Processing condition | Thickness of scale Total | Thickness of scale Outer layer | Structure of scale | Surface properties after straightening | Pipe-formability | Application of rust-inhibitor | Corrosion resistance I | Corrosion resistance II | evaluation |
|---|---|---|---|---|---|---|---|---|---|---|---|---|
| Present invention | 28 | a | (2) | 45 | 15 | S2 | ○ | ○ | Yes | ○ | ○ | ○ |
| | 29 | b | | 45 | 15 | | ○ | ○ | | ○ | ○ | ○ |
| | 30 | c | | 40 | 10 | | ○ | ○ | | ○ | ○ | ○ |
| | 31 | d | | 45 | 15 | | ○ | ○ | No | ○ | ○ | ○ |

TABLE 3-continued

| Category | Test No. | Steel sample | Processing condition | Thickness of scale Total | Thickness of scale Outer layer | Structure of scale | Surface properties after straightening | Pipe-formability | Application of rust-inhibitor | Corrosion resistance I | Corrosion resistance II | evaluation |
|---|---|---|---|---|---|---|---|---|---|---|---|---|
| | 32 | e | | 30 | 13 | | ○ | ○ | | ○ | ○ | ○ |
| | 33 | f | | 20 | 10 | | ○ | ○ | | ○ | ○ | ○ |
| | 34 | a | ③ | 28 | 14 | S1 | ○ | ○ | Yes | ○ | ○ | ○ |
| | 35 | b | | 30 | 15 | | ○ | ○ | | ○ | ○ | ○ |
| | 36 | c | | 25 | 12 | | ○ | ○ | | ○ | ○ | ○ |
| | 37 | d | | 30 | 15 | | ○ | ○ | No | ○ | ○ | ○ |
| | 38 | e | | 25 | 11 | | ○ | ○ | | ○ | ○ | ○ |
| | 39 | f | | 20 | 10 | | ○ | ○ | | ○ | ○ | ○ |
| Comparison | 40 | a | ① | 75 | 32 | S3 | x | ○ | Yes | x | ○ | x |
| | 41 | b | | 70 | 35 | | x | ○ | | x | ○ | x |
| | 42 | c | | 80 | 40 | | x | ○ | | x | ○ | x |
| | 43 | d | | 70 | 35 | | x | ○ | | x | ○ | x |
| | 44 | e | | 80 | 40 | | x | ○ | No | x | ○ | x |
| | 45 | f | | 60 | 30 | | x | ○ | | x | ○ | x |
| | 46 | g | | 75 | 37 | | x | ○ | Yes | x | x | x |
| | 47 | h | | 75 | 38 | | x | x | No | x | ○ | x |
| | 48 | i | | 75 | 37 | | x | ○ | Yes | x | ○ | x |
| | 49 | g | ② | 50 | 15 | S2 | ○ | ○ | | ○ | x | x |
| | 50 | h | | 45 | 12 | | ○ | x | No | ○ | ○ | x |
| | 51 | i | | 50 | 15 | S3 | x | ○ | Yes | x | ○ | x |
| | 52 | g | ③ | 28 | 14 | S1 | ○ | ○ | | ○ | x | x |
| | 53 | h | | 25 | 13 | | ○ | x | No | ○ | ○ | x |
| | 54 | i | | 30 | 15 | S3 | x | ○ | Yes | x | ○ | x |

As is apparent from Table 3, the steel pipes of Comparative Examples (Test Nos. 28 to 33) which were processed in the process (1) after finish rolling and were not processed in descaling step after reheating in the quenching furnace had, regardless of their chemical composition, a dual scale layer on the outside surface of the steel pipes having a total thickness of 70 μm or more, an outer scale layer thickness of 30 μm or more, and the scale structure S3 characterized by having many micro cracks. As a result, the steel pipes had poor surface properties inside the pipe after straightening and suffered rust formation in the corrosion test 1, because of peeling of their outer scale layer, regardless of the presence or absence of the rust-inhibiting oil coating.

The steel pipes consisting of steel g of Comparative Examples (Test Nos. 46, 49, and 52) showed poor results on the inside surface, having scale as formed in the corrosion test 2; namely, poor corrosion resistance in a carbon dioxide gas atmosphere, because of their poor Cr content of 8%.

Further, the steel pipes consisting of steel h of Comparative Examples (Test Nos. 47, 50, and 53) suffered quench cracks in quenching process and poor formability for pipe-making, regardless of the processing conditions after finish rolling, because of their excess C content of 0.6%, which falls outside the ranges defined by the present invention.

The steel pipes consisting of steel i of Comparative Examples (Test Nos. 51 and 54) manufactured under the processing condition (2) or (3) of the present invention after finish rolling had a dual scale layer thickness on the outside surface having a total thickness of 50 μm or less. However, because the pipes had a Mn content of 2.1% or more, which falls outside the ranges defined by the present invention, the pipes had the scale structure S3 characterized by having many micro cracks, because of formation of much FeO—$Mn_2O_3$—based spinel-type oxide. As a result, the pipes had poor surface properties inside the pipe after straightening and suffered rust formation in the corrosion test 1 regardless of the presence or absence of rust-inhibiting oil coating, because of peeling of the inner scale in the test.

By contrast, the steel pipes of Examples of the present invention (test Nos. 28 to 39) consisting of steel a to f having the chemical compositions which are within the ranges defined by the present invention manufactured in the processing condition (2) or (3) after finish rolling had a dual scale layer having a total thickness of 30 μm or less on the outer surface of the pipe with the thickness of the outer scale layer being 15 μm or less; or had a dual scale layer having a total thickness of 50 μm or less with the thickness of the outer scale layer being 15 μm or less, and the scale structure S1 or S2 characterized by having few micro cracks. As a result, the steel pipes had excellent surface properties inside the pipe after straightening and suffered no rust formation in the corrosion test 1 regardless of the presence or absence of rust-inhibiting oil coating, because the outer scale layer did not suffer peeling in the test. Further, the results of corrosion test 2 of the outside surface with the dual scale layers; namely, the corrosion resistance in a carbon dioxide gas atmosphere, were excellent. The steel pipes suffered no quench cracks in the quenching process and had excellent formability for pipe-making.

EXAMPLE 3

Ingots consisting of 3 kinds of martensitic stainless steels; namely, steels a, e, and f among the stainless steels shown in the above-described Table 1, were heated at 1250° C. and subjected to hot-forging to yield blocks having a thickness of 40 mm. Then, the blocks were re-heated at 1250° C. and hot-rolled to obtain sheets having a thickness of 12 mm.

Then, among the resultant sheets, the sheets consisting of steels a and e were quenched by heating the steels at 980° C. for 60 minutes and air-cooling the steels, and then tempered by heating the steels at 700° C. for 30 minutes and air-cooling the steels to obtain sheet steel having a dual scale layer.

Further, the sheet consisting of steel f was quenched by heating the steel at 950° C. for 60 minutes and water-cooling the steel, and then tempered by heating the steel at 640° C. for 30 minutes and air-cooling the steel to obtain sheet steel having a dual scale layer.

The surfaces of the resultant sheet steel having a dual scale layer were descaled by use of an alumina-blasting type shot blaster for different periods of time to obtain sheet steel having a $Fe_2O_3$ layer existing on the surface of the outer scale layer of a thickness of 0.3 to 6.8 μm.

Sheet steel having a dual scale layer but no $Fe_2O_3$ layer on the surface of the outer scale layer was produced by maintaining oxygen partial pressure within each of the heating furnaces at $10^{-3}$ atm in the quenching process. The same samples for the corrosion test as mentioned above were also produced from the sheet steel.

The total thickness of the dual scale layer, the thickness of the outer scale layer, the thickness of $Fe_2O_3$ layer on the surface of the outer scale layer, and the presence or absence of micro cracks of the resultant samples were investigated by use of the same methods as in Example 1. The scale structures were classified according to the same standards as in Example 2.

A corrosion resistance test (for measuring resistance to sulfide stress cracking in a carbon dioxide gas atmosphere containing hydrogen sulfide) was performed by exposing four-point bent samples having a thickness of 2 mm, a width of 10 mm, and a length of 75 mm produced from corrosion resistance test samples under an atmosphere containing hydrogen sulfide in different concentrations shown in Table 4. At this time, for the sake of providing a standard for comparison, four-point bent samples having the same sizes as described above which had been completely stripped of scale layers on all surfaces by wet-polishing with #600 emery paper were subjected to the same sulfide stress cracking (SSC) test.

Notches of U-shaped cross section having a depth of 0.25 mm and a radius of curvature of 0.25 mm were formed in the vertically central portion of the four-point bent samples, in order to simulate micro cracks extending through the scale layers to the steel surface.

During the test, the four-point bent samples were loaded with 100% bending stress based on 0.2% proof stress.

The test was performed by removing the samples from the corrosive environment to which they had been subjected for 720 hrs, observing the appearance of the samples, and investigating the presence and absence of cracks by observing the cross section of the samples through an optical microscope.

The evaluation of the test results was carried out with reference to the results of samples which had been stripped of the scale layers by polishing all the surfaces, as follows:

Poor resistance to sulfide stress cracking (poor SSC resistance)

"X"—samples suffered sulfide stress cracks under the environment in which the standard samples suffered no sulfide stress crack.

Good SSC resistance

"O"—samples suffered no sulfide stress cracks under the same environment.

The results of the test are shown in Table 5, along with, the total thickness of the dual scale layer, the thickness of the outer scale layer, the thickness of $Fe_2O_3$ layer existing on the surface of the sample, the scale layer structure, and the test conditions.

TABLE 4

| Test condition | $H_2S$ (atm) | $CO_2$ (atm) | NaCl (wt. %) | pH | Immersion time (hr) |
|---|---|---|---|---|---|
| A | 0.003 | 30 | 10 | 3.5 | 720 |
| B | 0.001 | 30 | 1 | 4.5 | 720 |
| C | 0.01 | 30 | 5 | 4.0 | 720 |

TABLE 5

| Category | Test No. | Steel sample | Thickness of scale layer (μm) Total | Outer layer | Surface $Fe_2O_3$ | Structure of scale | Conditions for corrosion test | SSC | Evaluation |
|---|---|---|---|---|---|---|---|---|---|
| Present Invention | 55 | e | 48 | 14 | 0.3 | S2 | A | No | ○ |
| | 56 | a | 46 | 15 | 2.4 | | B | No | ○ |
| | 57 | f | 48 | 13 | 4.7 | | C | No | ○ |
| | 58 | e | 42 | 14 | 0 | | A | No | ○ |
| | 59 | | 42 | 15 | *6.5 | | | Yes | x |
| | 60 | a | 43 | 14 | *5.9 | | B | Yes | x |
| | 61 | f | 44 | 13 | *6.8 | | C | Yes | x |
| Referential Steel | 62 | e | | (Polishing) | | — | A | No | — |
| | 63 | a | | | | | B | No | — |
| | 64 | f | | | | | C | No | — |

Note) "*": Outside the preferable ranges specified in the present invention.

As is apparent from Table 5, the sheet steels (Test Nos. 55 to 58) of the Examples, which had a $Fe_2O_3$ layer of not more than 5 μm thickness on the surface of the outer scale layer, had good SSC resistance, as the local corrosion on the notch bottom did not proceed to excess and SSC did not occur.

By contrast, the sheet steels (Test Nos. 59 to 61), which had a $Fe_2O_3$ layer of more than 5 μm thickness, had poor SSC resistance because the local corrosion on the notch bottom occurred. Therefore, if improved SSC resistance is required, the preferable thickness of a $Fe_2O_3$ layer is 5 μm or less.

The martensitic stainless steel material having the dual scale layer of the present invention has excellent surface properties and does not reduce the accuracy of non-destructive inspection and the uniform property of rust-inhibiting oil coating. Further, the dual scale layer formed on the surfaces of the stainless steel material does not peel off and does not fall out after shipping. In the case where the stainless steel material is processed into steel pipes, even if the steel pipes are used, for example, as oil country tubular goods, the pipes have excellent corrosion resistance in a carbon dioxide gas atmosphere.

Moreover, the steel which has a $Fe_2O_3$ layer of 5 μm or less thickness including zero has excellent SSC resistance in an atmosphere containing hydrogen sulfide; more specifically, under a carbon dioxide gas atmosphere containing hydrogen sulfide.

Furthermore, according to the method of the present invention, the reduction in manufacturing cost and improvement of working environments can be achieved. Especially, when the finish rolling process is finished at 900° C. or higher, and the tempering process is then carried out without reheating quenching treatment, not only is energy conserved, but also the descaling process requiring enormous amounts of cost and labor becomes unnecessary. Therefore, substantial reduction in manufacturing costs and improvement of working environment are accomplished.

What is claimed is:

1. A martensitic stainless steel product, having a dual oxide scale layer, comprising a base steel and a dual oxide scale layer on a surface of the base steel, wherein the base steel is martensitic stainless steel containing, by weight, C: not greater than 0.5%, Si: not greater than 1%, Mn: not greater than 2%, Cr: 9 to 16%, Ni: 0 to 7%, Mo: 0 to 7%, Ti: 0 to 0.2%, Zr: 0 to 0.2%, Nb: 0 to 0.1%, and sol.Al: 0 to 0.1%; and the dual scale layer comprises an inner scale layer containing $FeCr_2O_4$ and $Fe_3O_4$ as main components, and an outer scale layer containing $Fe_3O_4$ as a main component and having an outermost layer consisting of $Fe_2O_3$; or comprises an inner scale layer containing $FeCr_2O_4$ and FeO as main components, and an outer scale layer containing FeO and $Fe_3O_4$ as main components and having an outermost layer consisting of $Fe_2O_3$, wherein the dual scale layer has a total thickness of 50 μm or less, and the outer scale layer including the outermost layer has a thickness of 15 μm or less.

2. The martensitic stainless steel product, according to claim 1, wherein the dual oxide scale layer has a total thickness of 30 μm or less.

3. The martensitic stainless steel product, according to claim 1, wherein the outermost layer consisting of $Fe_2O_3$, has a thickness of 5 μm or less.

4. The martensitic stainless steel product, according to claim 1, wherein the Mn content of the base steel is 1.5% or less by weight.

5. The martensitic stainless steel product, according to claim 1, wherein the product is a seamless steel pipe having the dual oxide scale layer on at least one of its inner and outer surfaces.

6. The martensitic stainless steel product, according to claim 1, wherein the product is a welded steel pipe having the dual oxide scale layer on at least one of its inner and outer surfaces.

7. The seamless steel pipe, according to claim 5, wherein the steel pipe has a film of rust-inhibiting oil on the surface of the dual oxide scale layer.

8. The welded steel pipe, according to claim 6, wherein the steel pipe has a film of rust-inhibiting oil on the surface of the dual oxide scale layer.

* * * * *